US005914689A

United States Patent [19]

Cockson

[11] Patent Number: 5,914,689

[45] Date of Patent: Jun. 22, 1999

[54] ANTENNA FOR A PORTABLE, WIRELESS COMMUNICATION DEVICE

[75] Inventor: Mark G. Cockson, Roca, Nebr.

[73] Assignee: Centurion Intl., Inc., Lincoln, Nebr.

[21] Appl. No.: 08/882,133

[22] Filed: Jun. 25, 1997

[51] Int. Cl.[6] ..... H01Q 1/24

[52] U.S. Cl. ..... 343/702; 343/895; 343/850

[58] Field of Search ..... 343/702, 895, 343/850, 906, 900, 901, 860; 455/575, 129, 280; H01Q 1/24

[56] References Cited

U.S. PATENT DOCUMENTS

| | | | |
|---|---|---|---|
| 3,803,627 | 4/1974 | Schuscheng | 343/903 |
| 4,205,319 | 5/1980 | Gasparaitis et al. | 343/792 |
| 4,760,401 | 7/1988 | Imazeki | 343/702 |
| 4,772,895 | 9/1988 | Garay et al. | 343/895 |
| 4,849,767 | 7/1989 | Naitou | 343/745 |
| 4,867,698 | 9/1989 | Griffiths | 439/317 |
| 5,079,558 | 1/1992 | Koike | 343/702 |
| 5,177,492 | 1/1993 | Tomura et al. | 343/702 |
| 5,204,687 | 4/1993 | Elliott et al. | 343/702 |
| 5,245,350 | 9/1993 | Sroka | 343/702 |
| 5,300,940 | 4/1994 | Simmons | 343/749 |
| 5,317,325 | 5/1994 | Bottomley | 343/702 |
| 5,353,036 | 10/1994 | Baldry | 343/702 |
| 5,374,937 | 12/1994 | Tsunekawa et al. | 343/702 |
| 5,446,469 | 8/1995 | Makino | 343/702 |
| 5,467,096 | 11/1995 | Takamoro et al. | 343/702 |
| 5,469,177 | 11/1995 | Rush et al. | 343/702 |
| 5,479,178 | 12/1995 | Ha | 343/702 |
| 5,594,457 | 1/1997 | Wingo | 343/702 |
| 5,646,635 | 7/1997 | Cockson et al. | 343/702 |
| 5,659,889 | 8/1997 | Cockson | 455/575 |
| 5,686,927 | 11/1997 | Simmons | 343/702 |

FOREIGN PATENT DOCUMENTS

| | | |
|---|---|---|
| 3245603 | 11/1991 | Japan . |
| 685519 | 3/1994 | Japan . |
| 6252621 | 9/1994 | Japan . |

OTHER PUBLICATIONS

Doug DeMaw "Lightweight Trap Antennas—Some Thoughts", pp. 15–18, Jun. 1983.

*Primary Examiner*—Robert H. Kim
*Assistant Examiner*—Layla G. Lauchman
*Attorney, Agent, or Firm*—Zarley, McKee, Thomte, Voorhees & Sease; Dennis L. Thomte

[57] ABSTRACT

An antenna for a portable, wireless communication device comprising an antenna sheath having the mechanical components of the antenna positioned therein. The sheath is provided with a first bore formed in the base end thereof which is adapted to receive an electrically conductive, connector element therein. The sheath is also provided with a second bore formed therein at the inner end of the first bore which is adapted to receive a first helical antenna element therein. The sheath is further provided with a third bore formed therein at the inner end of the second bore which is adapted to receive a second helical antenna element therein. The second and third bores have a plurality of longitudinally extending, radially spaced-apart ribs protruding inwardly into the bores for engagement with the antenna elements therein to position the antenna elements in the bores and to create air dielectric chambers between the sheath and the antenna elements.

31 Claims, 3 Drawing Sheets

ANTENNA FOR A PORTABLE, WIRELESS COMMUNICATION DEVICE

BACKGROUND OF THE INVENTION

1. Field of the Invention

This invention relates to an antenna and more particularly to an antenna for a portable, wireless communication device having a unique sheath design.

2. Description of the Related Art

Antennas for portable, wireless communication devices such as two-way radios, cellular telephones, etc., normally include a thermoplastic or rubber sheath which encloses the mechanical components of the antenna. In most cases, the conventional antenna includes an electrically conductive connector positioned at the base of the antenna for connection to the circuitry of the radio. The conventional antenna normally also includes at least one helical radiating antenna element electrically connected to the connector and which extends therefrom. In many cases, a pair of series-connected, helical radiating antenna elements are employed. The length of the helical radiating antenna elements is determined by the frequency of the antenna. Thus, when a manufacturer produces antennas having various frequencies, it is necessary for the manufacturer to have a large number of different antennas in inventory, since the sheaths for the antennas are normally manufactured to accommodate specific antenna elements having a particular frequency. Further, the conventional antennas normally employ a cap which is secured to the tip end of the antenna for sealing the interior of the antenna. One reason why conventional antenna sheaths employ a cap at the tip end thereof is to facilitate the assembly of the antenna. However, the cap, which is bonded onto the tip end of the antenna sheath, sometimes becomes loose resulting in field failure.

SUMMARY OF THE INVENTION

An antenna is provided for a portable, wireless communication device which includes an elongated, hollow sheath comprised of a dielectric material and including a base end and a tip end. The sheath has a first bore formed therein which extends inwardly into the base end thereof and which is adapted to receive an electrically conductive connector element therein. The sheath also has a second bore formed therein which extends inwardly from the inner end of the first bore towards the tip end and which is adapted to receive a first helical radiating antenna element therein which is electrically connected to the connector element in the first bore. The sheath also has a third bore formed therein which extends inwardly from the inner end of the second bore towards the tip end and which is adapted to receive a second helical radiating antenna element therein which is electrically connected to the first helical radiating antenna element. The sheath has a plurality of longitudinally extending, radially spaced-apart ribs which extend into the second and third bores for engagement with the antenna elements therein. The ribs provided in the second and third bores engage the helical antenna elements so that the antenna elements will not rattle inside the sheath. Further, the ribs provided in the second and third bores create air dielectric chambers therebetween. The sheath is of one-piece construction to eliminate the disadvantages of the prior art wherein a separate cap was bonded onto the end of the sheath. The length of the sheath is constant regardless of the frequency of the antenna.

Therefore, it is a principal object of the invention to provide an improved antenna for a portable, two-way radio.

Still another object of the invention is to provide an antenna including an elongated sheath which is adapted to fit multiple frequency antennas.

Yet another object of the invention is to provide a unique antenna sheath which reduces the cost of tooling.

Still another object of the invention is to provide an antenna having improved performance which has the same overall length regardless of frequency.

Still another object of the invention is to provide an antenna sheath having means therein for preventing the antenna elements from rattling within their respective compartments in the sheath.

Still another object of the invention is to provide an antenna which eliminates the snug fitting construction of the prior art thereby preventing a drop in dielectric loading and detuning normally caused by a snug fitting sheath.

Still another object of the invention is to provide an antenna which is economical of manufacture, durable in use and refined in appearance.

These and other objects will be apparent to those skilled in the art.

DESCRIPTION OF THE PREFERRED EMBODIMENT

Figure 1:
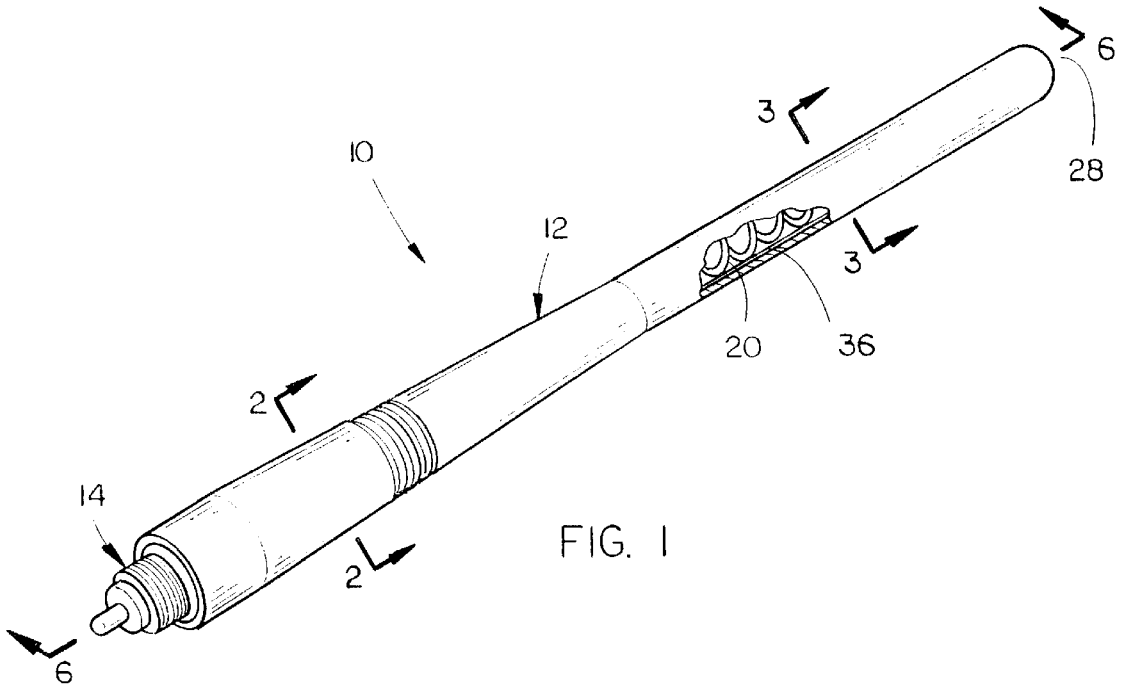
FIG. 1 is a perspective view of the antenna of this invention with a portion thereof cut-away to more fully illustrate the invention.
Figure 2:
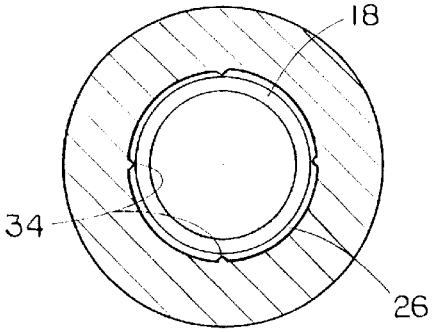
FIG. 2 is an enlarged sectional view as seen on lines 2—2 of FIG. 1.
Figure 3:
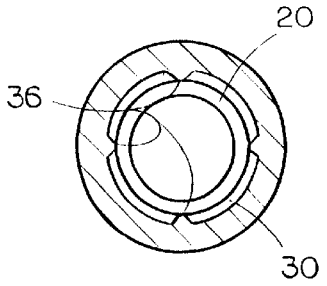
FIG. 3 is an enlarged sectional view as seen on lines 3—3 of FIG. 1.

The antenna of this invention is referred to generally by the reference numeral 10 and generally includes a sheath 12 adapted to enclose the mechanical components of the antenna as will be described hereinafter. Preferably, sheath 12 is constructed of a suitable conventional, dielectric thermoplastic or rubber material.

Figure 4:
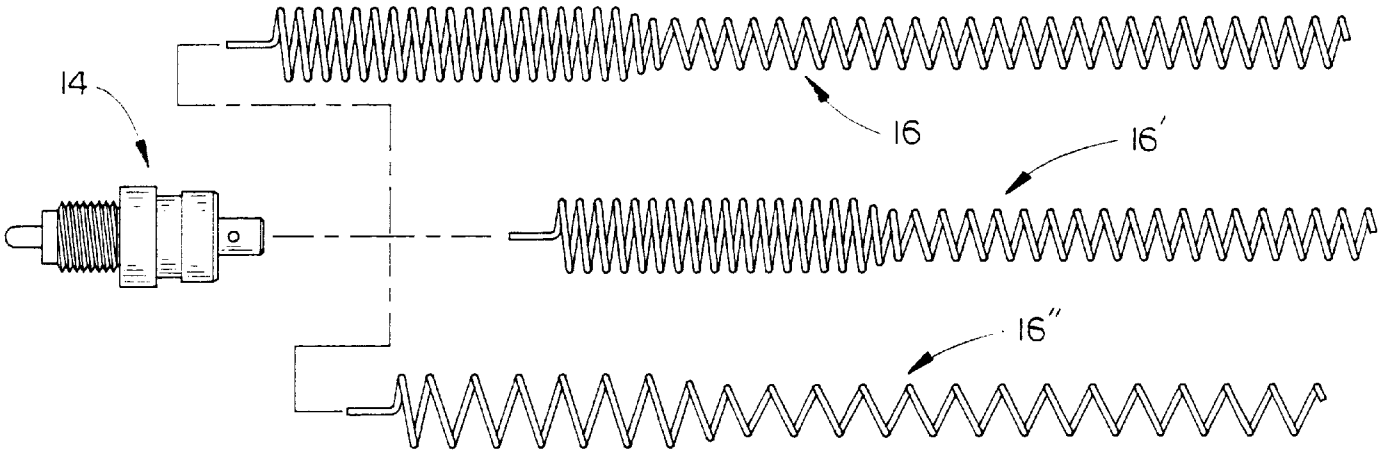
FIG. 4 exploded perspective view of the internal components of three different embodiments of the antenna.
Figure 5:
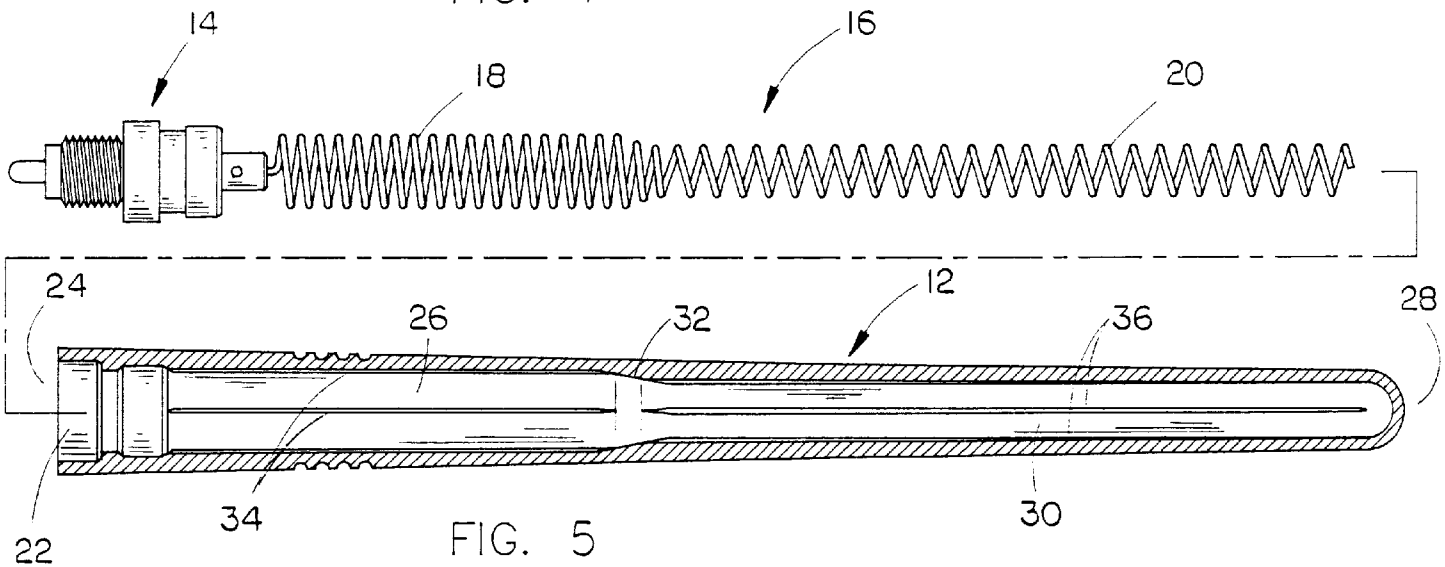
FIG. 5 is an exploded perspective view of one form of the antenna.
Figure 6:
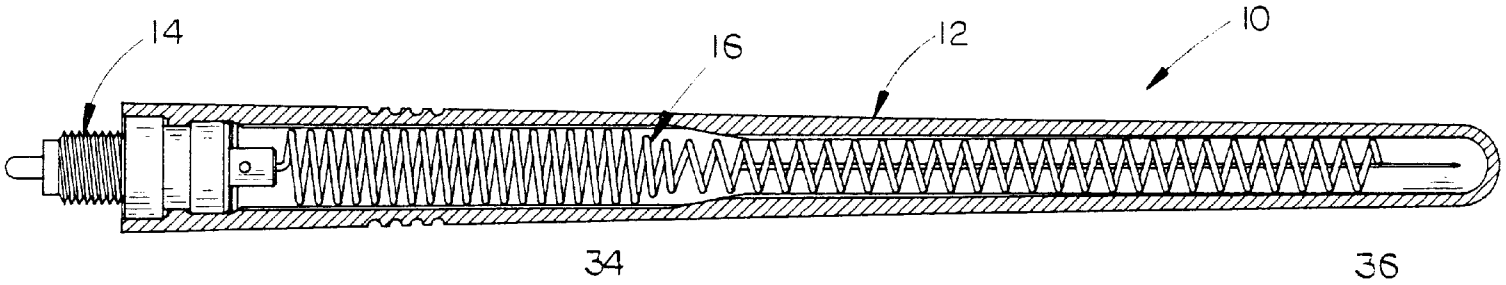
FIG. 6 is a longitudinal sectional view of one form of the antenna.
Figure 7:
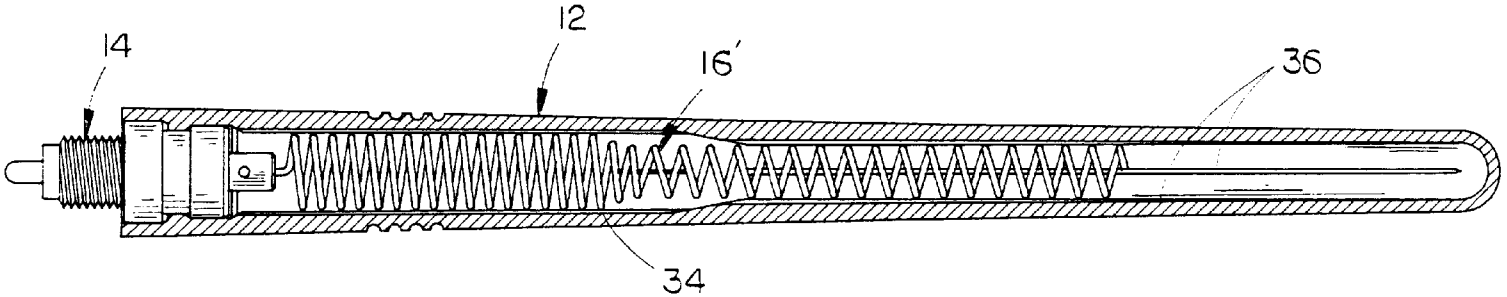
FIG. 7 is a longitudinal sectional view of a second form of the antenna.
Figure 8:
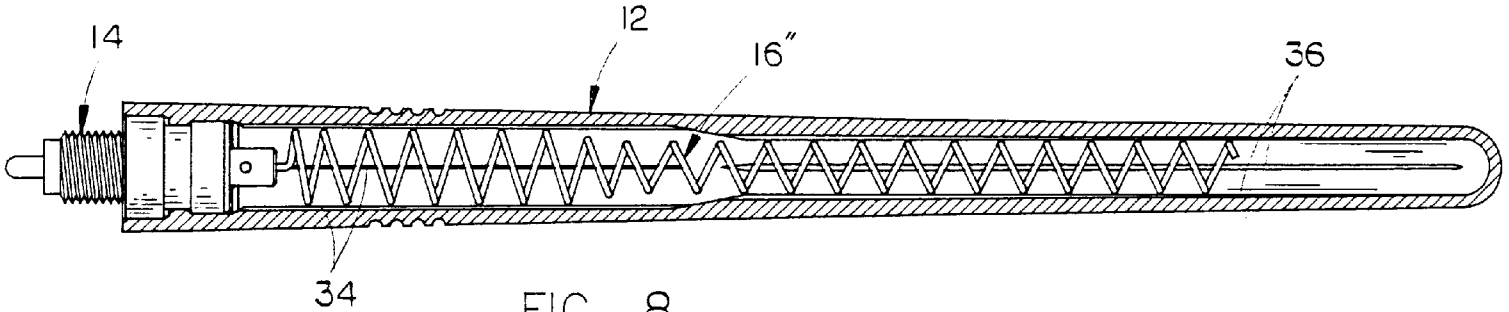
FIG. 8 is a longitudinal sectional view of a third form of the antenna.

Antenna 10 includes a connector 14 which is adapted to be electrically conducted to the circuitry of the wireless communication device in conventional fashion. The numeral 16 refers to an antenna spring which is crimped or soldered to the connector 14. Antenna spring 16 includes a first helical antenna element 18 and a second helical antenna element 20. The length of the antenna element 18 will be dependent upon the frequency of the antenna. Similarly, the length of the antenna element 20 will also be dependent upon the frequency of the antenna. The overall length of the spring 16 will be dependent upon the frequency of the antenna. Although in most cases antenna element 20 will be utilized in conjunction with antenna element 18, it is conceivable that in some situations only antenna element 18 will be required or vice versa. As seen in the drawings, antenna element 18 has a greater diameter than antenna element 20. It should also be noted that antenna spring 16 could be comprised of a single spring, tapered or non-tapered, or a pair or individual springs. FIG. 4 illustrates three different configurations that antenna spring 16 may assume and which are identified by the reference numerals 16, 16' and 16", respectively. Those three antenna springs 16, 16' and 16" are also illustrated in FIGS. 6, 7 and 8, respectively. As seen, sheath 12 easily accommodates many different antenna spring configurations. Further, spring 16 could be replaced by a single, elongated wire or rod antenna element.

Sheath 12 includes a first bore 22 formed in its base end 24 and which extends inwardly thereinto. The configuration of the bore 22 will be dependent upon the exterior configuration of the particular connector 14 being utilized so that the connector 14 will be securely received within bore 22. Sheath 12 also includes a second bore 26 formed therein which extends inwardly from the inner end of bore 22 towards the tip end 28 of the sheath. Sheath 12 is also provided with a third bore 30 formed therein which extends inwardly from the inner end of bore 26, as seen in the drawings. A shoulder 32 is defined between bores 26 and 30. It should be noted that sheath 12 may be designed so as to have a single bore, tapered or non-tapered. It is also important to note that sheath 12 does not utilize an external, separate cap to close its upper or tip end.

Sheath 12 is provided with a plurality of elongated ribs 34 which protrude inwardly into bore 26, as illustrated in FIGS. 2, 3 and 5–8. As seen, the ribs 34 are radially spaced-apart and it is preferred that four of the ribs 34 be provided. Sheath 12 is also provided with a plurality of elongated ribs 36 which are radially spaced-apart and which extend inwardly into bore 30, as seen in FIGS. 2, 3 and 5–8. As seen in the drawings, ribs 34 have an overall "height" which is less than that of ribs 36 so that ribs 34 protrude less into the bore 26 than ribs 36 in bore 30. Preferably, four of the ribs 36 are provided in an equally spaced-apart relationship. As seen in the drawings, the ribs 34 and 36 are essentially V-shaped in section. It is preferred also that the ribs 34 and 36 are tapered from one end thereof to the other end thereof, that is, the ribs have a greater "height" at their lower ends than at their upper ends.

The antenna is assembled in an easy fashion by simply inserting the connector 14 having the antenna spring 16 mounted thereon into the base end of the sheath. When assembled, antenna element 20 is positioned in bore 30 with the ribs 36 engaging the exterior of the antenna element 20 to maintain the antenna element 20 in position so that it does not rattle within the sheath. Similarly, the ribs 34 engage the exterior of antenna element 18 to maintain the antenna element 18 in position so that it does not rattle. The engagement of the ribs 34 and 36 with the antenna elements 18 and 20 creates controlled dielectric chambers 38 between the sheath and the antenna elements 18 and 20.

The positioning of the antenna elements 18 and 20 within the bores 26 and 30, respectively, with the ribs engaging the exteriors thereof, reduces the dielectric loading and detuning caused by the snug fitting sheaths of the prior art devices. The antenna of this invention allows a single sheath to fit multiple frequency antennas, thereby reducing the cost of tooling and design cycle time. Further, the antenna of this invention provides an improved performance with the same overall length regardless of frequency. The lengths of bores 26 and 30 are such that they can accommodate antenna elements of various lengths. In some cases, depending upon the frequency of the antenna, the antenna element 20 will not extend to the inner end of the bore 30. Similarly, in some situations, the inner end of antenna element 18 will not extend completely to the inner end of bore 26, as seen in FIGS. 7 and 8. Further, in some situations, it is possible that the outer (lower) end of antenna element 20 will be partially positioned in bore 26 with the inner end thereof being positioned in bore 30 with the ribs 36 engaging the antenna element 20 to maintain the same in position without rattling.

Thus it can be seen that a unique sheath design has been provided which accomplishes all of its stated objectives.

I claim:

1. An antenna sheath for a transceiver antenna, comprising:

an elongated, hollow sheath comprised of a dielectric material and having a base end and a tip end;

said sheath having a first bore formed therein which extends inwardly into its base end;

said first bore having inner and outer ends;

said first bore adapted to receive an electrically conductive connector element therein;

said sheath having a second bore formed therein which extends from the inner end of said first bore towards said tip end;

said second bore having inner and outer ends;

said second bore adapted to receive a first helical radiating antenna element therein which is electrically connected to the connector element in said first bore;

said sheath having a third bore formed therein which extends from the inner end of said second bore towards said tip end;

said third bore having inner and outer ends;

said third bore adapted to receive a second helical radiating antenna element therein which is electrically connected to said first helical radiating antenna element;

said second and third bores being elongated;

said sheath having a plurality of longitudinally extending, radially spaced-apart ribs extending into said third bore for engagement with the second antenna element therein;

said spaced-apart ribs defining air dielectric chambers between said sheath and the second antenna element therein.

2. An antenna sheath for a transceiver antenna, comprising:

an elongated, hollow sheath comprised of a dielectric material and having a base end and a tip end;

said sheath having a first bore formed therein which extends inwardly into its base end;

said first bore having inner and outer ends;

said first bore adapted to receive an electrically conductive connector element therein;

said sheath having a second bore formed therein which extends from the inner end of said first bore towards said tip end;

said second bore having inner and outer ends;

said second bore adapted to receive a first helical radiating antenna element therein which is electrically connected to the connector element in said first bore;

said sheath having a third bore formed therein which extends from the inner end of said second bore towards said tip end;

said third bore having inner and outer ends;

said third bore adapted to receive a second helical radiating antenna element therein which is electrically connected to said first helical radiating antenna element;

said second and third bores being elongated;

said sheath having a plurality of longitudinally extending, radially spaced-apart ribs extending into said second bore for engagement with the first antenna element therein;

said spaced-apart ribs defining air dielectric chambers between said sheath and the first antenna element therein.

3. An antenna sheath for a transceiver antenna, comprising:

an elongated, hollow sheath comprised of a dielectric material and having a base end and a tip end;

said sheath having a first bore formed therein which extends inwardly into its base end;

said first bore having inner and outer ends;

said first bore adapted to receive an electrically conductive connector element therein;

said sheath having a second bore formed therein which extends from the inner end of said first bore towards said tip end;

said second bore having inner and outer ends;

said second bore adapted to receive a first helical radiating antenna element therein which is electrically connected to the connector element in said first bore;

said sheath having a third bore formed therein which extends from the inner end of said second bore towards said tip end;

said third bore having inner and outer ends;

said third bore adapted to receive a second helical radiating antenna element therein which is electrically connected to said first helical radiating antenna element;

said second and third bores being elongated;

said sheath having a plurality of longitudinally extending, radially spaced-apart ribs extending into said second bore for engagement with the first antenna element therein;

said sheath having a plurality of longitudinally extending radially spaced-apart ribs extending into said third bore for engagement with the second antenna element therein;

said spaced-apart ribs defining air dielectric chambers between said sheath and the antenna elements therein.

4. The antenna sheath of claim 1 wherein said third bore has a diameter which is less than the diameter of said second bore.

5. The antenna sheath of claim 2 wherein said third bore has a diameter which is less than the diameter of said second bore.

6. The antenna sheath of claim 3 wherein said third bore has a diameter which is less than the diameter of said second bore.

7. An antenna for a transceiver including circuitry, comprising:

an elongated, hollow sheath comprised of a dielectric material and having a base end and a tip end;

said sheath having a first bore formed therein which extends inwardly into its base end;

said first bore having inner and outer ends;

an electrically conductive connector element in said first bore for RF connection to the transceiver circuitry;

said sheath having a second bore formed therein which extends from the inner end of said first bore towards said tip end;

said second bore having inner and outer ends;

a first helical radiating antenna element in said second bore which is electrically connected to said connector element in said first bore;

said sheath having a third bore formed therein which extends from the inner end of said second bore towards said tip end;

said third bore having inner and outer ends;

a second helical radiating antenna element in said third bore which is electrically connected to said first antenna element;

said sheath having a plurality of longitudinally extending, radially spaced-apart ribs extending into said third bore for engagement with the second antenna element therein;

said spaced-apart ribs defining air dielectric chambers between said sheath and the second antenna element therein.

8. An antenna for a transceiver including circuitry, comprising:

an elongated, hollow sheath comprised of a dielectric material and having a base end and a tip end;

said sheath having a first bore formed therein which extends inwardly into its base end;

said first bore having inner and outer ends;

an electrically conductive connector element in said first bore for RF connection to the transceiver circuitry;

said sheath having a second bore formed therein which extends from the inner end of said first bore towards said tip end;

said second bore having inner and outer ends;

a first helical radiating antenna element in said second bore which is electrically connected to said connector element in said first bore;

said sheath having a third bore formed therein which extends from the inner end of said second bore towards said tip end;

said third bore having inner and outer ends;

a second helical radiating antenna element in said third bore which is electrically connected to said first antenna element;

said sheath having a plurality of longitudinally extending, radially spaced-apart ribs extending into said second bore for engagement with said first antenna element therein;

said spaced-apart ribs defining air dielectric chambers between said sheath and said first antenna element.

9. An antenna for a transceiver, including circuitry, comprising:

an elongated, hollow sheath comprised of a dielectric material and having a base end and a tip end;

said sheath having a first bore formed therein which extends inwardly into its base end;

said first bore having inner and outer ends;

an electrically conductive connector element in said first bore for RF connection to the transceiver circuitry;

said sheath having a second bore formed therein which extends from the inner end of said first bore towards said tip end;

said second bore having inner and outer ends;

a first helical radiating antenna element in said second bore which is electrically connected to said connector element in said first bore;

said sheath having a third bore formed therein which extends from the inner end of said second bore towards said tip end;

said third bore having inner and outer ends;

a second helical radiating antenna element in said third bore which is electrically connected to said first antenna element;

said sheath having a plurality of longitudinally extending, radially spaced-apart ribs extending into said second bore for engagement with said first antenna element therein;

said sheath having a plurality of longitudinally extending, radially spaced-apart ribs extending into said third bore for engagement with said second antenna element therein;

said spaced-apart ribs defining air dielectric chambers between said sheath and the antenna elements therein.

10. The antenna of claim 7 wherein said third bore has a diameter which is less than the diameter of said second bore.

11. The antenna of claim 8 wherein said third bore has a diameter which is less than the diameter of said second bore.

12. The antenna of claim 9 wherein said third bore has a diameter which is less than the diameter of said second bore.

13. The antenna sheath of claim 1 wherein said sheath is of one-piece construction.

14. The antenna sheath of claim 2 wherein said sheath is of one-piece construction.

15. The antenna sheath of claim 3 wherein said sheath is of one-piece construction.

16. The antenna sheath of claim 7 wherein said sheath is of one-piece construction.

17. The antenna sheath of claim 8 wherein said sheath is of one-piece construction.

18. The antenna sheath of claim 9 wherein said sheath is of one-piece construction.

19. The antenna of claim 7 wherein said third bore has a length sufficient to receive antenna elements of various lengths.

20. The antenna of claim 8 wherein said third bore has a length sufficient to receive antenna elements of various lengths.

21. The antenna of claim 9 wherein said third bore has a length sufficient to receive antenna elements of various lengths.

22. The antenna of claim 7 wherein said second bore has a length sufficient to receive antenna elements of various lengths.

23. The antenna of claim 8 wherein said second bore has a length sufficient to receive antenna elements of various lengths.

24. The antenna of claim 9 wherein said second bore has a length sufficient to receive antenna elements of various lengths.

25. The antenna of claim 9 wherein said ribs are substantially V-shaped.

26. The antenna of claim 9 wherein the said ribs in said third bore extend into said third bore a greater distance than said ribs in said second bore extend into said second bore.

27. The antenna of claim 9 wherein four equally spaced ribs extend inwardly into each of said second and third bores.

28. An antenna sheath for a transceiver antenna, comprising:

an elongated, hollow sheath comprised of a dielectric material and having a base end and a tip end;

said sheath having a first bore formed therein which extends inwardly into its base end;

said first bore having inner and outer ends;

said first bore adapted to receive an electrically conductive connector element therein;

said sheath having a second bore formed therein which extends from the inner end of said first bore towards said tip end;

said second bore having inner and outer ends;

said second bore adapted to receive an elongated radiating antenna element therein which is electrically connected to the connector element in said first bore;

said sheath being of unitary construction.

29. The antenna sheath of claim 28 wherein said sheath has a plurality of longitudinally extending, radially spaced-apart ribs extending into said second bore for engagement with the antenna element therein.

30. An antenna for a transceiver antenna, comprising:

an elongated, hollow sheath comprised of a dielectric material and having a base end and a tip end;

said sheath having a first bore formed therein which extends inwardly into its base end;

said first bore having inner and outer ends;

said first bore having an electrically conductive connector element therein;

said sheath having a second bore formed therein which extends from the inner end of said first bore towards said tip end;

said second bore having inner and outer ends;

said second bore having at least a portion of a first helical radiating antenna element positioned therein which is electrically connected to the connector element in said first bore;

said sheath having a third bore formed therein which extends from the inner end of said second bore towards said tip end;

said third bore having inner and outer ends;

said third bore having at least a portion of said first helical radiating antenna element therein which is electrically connected to said first helical radiating antenna element;

said second and third bores being elongated;

said sheath having a plurality of longitudinally extending, radially spaced-apart ribs extending into said second bore for engagement with the first antenna element therein;

said spaced-apart ribs defining air dielectric chambers between said sheath and the first antenna element therein.

31. An antenna for a transceiver antenna, comprising:

an elongated, hollow sheath comprised of a dielectric material and having a base end and a tip end;

said sheath having a first bore formed therein which extends inwardly into its base end;

said first bore having inner and outer ends;

said first bore having an electrically conductive connector element therein;

said sheath having a second bore formed therein which extends from the inner end of said first bore towards said tip end;

said second bore having inner and outer ends;

said second bore having at least a portion of a first helical radiating antenna element positioned therein which is electrically connected to the connector element in said first bore;

said sheath having a plurality of longitudinally extending, radially spaced-apart ribs extending into said second bore for engagement with the first antenna element therein;

said spaced-apart ribs defining air dielectric chambers between said sheath and the first antenna element therein.

* * * * *